US007001508B2

(12) United States Patent
Kurokawa et al.

(10) Patent No.: US 7,001,508 B2
(45) Date of Patent: Feb. 21, 2006

(54) OIL FILTERING DEVICE IN A CRANKCASE RECESS

(75) Inventors: Masaya Kurokawa, Wako (JP); Atsuo Hojo, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 47 days.

(21) Appl. No.: 10/786,711

(22) Filed: Feb. 24, 2004

(65) Prior Publication Data

US 2004/0211715 A1 Oct. 28, 2004

(30) Foreign Application Priority Data

Mar. 19, 2003 (JP) ..... 2003-075425

(51) Int. Cl.
*F01M 11/03* (2006.01)
*B01D 35/02* (2006.01)

(52) U.S. Cl. ..... 210/168; 210/416.5; 123/196 A

(58) Field of Classification Search ..... 210/167, 210/168, 232, 416.1, 416.5; 123/196 A
See application file for complete search history.

(56) References Cited

U.S. PATENT DOCUMENTS 1,800,585 A * 4/1931 Woolson ..... 210/168
3,773,144 A * 11/1973 Hummel ..... 184/6.24
4,915,852 A * 4/1990 Tomlinson ..... 210/805
5,588,405 A 12/1996 Sawa et al.
5,626,111 A 5/1997 Kawakubo et al.
6,024,193 A 2/2000 Fukushima
6,517,710 B1 * 2/2003 Hartmann et al. ..... 210/168

FOREIGN PATENT DOCUMENTS

JP 61-45286 12/1986
JP 4 292514 10/1992

* cited by examiner

*Primary Examiner*—Fred G. Prince
(74) *Attorney, Agent, or Firm*—Hamre, Schumann, Mueller & Larson, P.C.

(57) ABSTRACT

An oil filtering device disposed at a position apart from a crankshaft in a crankcase. An oil filtering device 24 is constituted in that a filter storage 34 formed in a left half case body 1*a* of a crankcase 1 contains a filter element 37, and a lid 47 of a filter flange 46 is fitted in an opening 36 of the filter storage 34. An extension part 48 extending outward from the lid 47 is formed in the filter flange 46, and the filter flange 46 has a communication passage 53 inside. Then, an oil passage 57 communicating with the tip of a crankshaft 16 is formed in a crank cover 1*b*. A connection part 50 formed on the tip of the extension part 48 of the filter flange 46 is fitted in a flange connection part 58 which communicates with the oil passage 57. Oil is supplied to the tip of the crankshaft 16 from the oil filtering device 24. The filter flange 46 is supported by the left half case body 1*a* and the crank cover 1*b*.

4 Claims, 6 Drawing Sheets

OIL FILTERING DEVICE IN A CRANKCASE RECESS

FIELD OF THE INVENTION

The present invention relates to an oil filtering device disposed in a crankcase which contains a crankshaft of an internal combustion engine.

BACKGROUND OF THE INVENTION

An oil filtering device attached to a crankcase or an exterior wall of a crankcase cover generally employs a structure, in which oil is caused to flow into a filter chamber containing a filter element from an inlet, which is formed on the crankcase or the wall of the crankcase cover, and filtered by the filter element, and the filtered oil is supplied to a lubricated part such as a crankshaft through an oil outlet and an outlet passage similarly formed on the crankcase or the crankcase cover. Thus, the oil filtering device is disposed around an end of the crankshaft e.g., refer to Japanese Utility Model Laid-Open No. 61-45286.

However, when the oil filtering device is disposed around the end of the crankshaft, the attachment of accessories (a large gear and a clutch or a rotary member such as ACG) to the crankshaft is limited. Thus, it is difficult to miniaturize the crankcase. As a result, there has been a problem that the size of the internal combustion engine is increased.

The present invention has been devised in consideration of the problem.

SUMMARY OF THE INVENTION

To solve the problem, an oil filtering device according to the present invention, in which a crankcase of an internal combustion engine rotatably retains a crankshaft inside, and an oil passage supplying oil to the crankshaft and a connection hole communicating with the oil passage (e.g., flange connection part 58) formed in the crankcase, includes a filter element disposed in a recess (e.g., filter storage 34 in an embodiment) formed inside the crankcase, and a filter flange having a flat lid which has substantially a same shape as an opening of the recess and is fitted in the recess, a cylindrical extension part which extends outward substantially from a center of the lid and in which a communication hole penetrating an inside, and a connection part which is formed on a tip of the extension part and is fitted in the communication hole. The oil filtering device is constituted in that the filter element is disposed to separate a space enclosed by the recess and the lid into an inlet space communicating with an inlet hole formed thereon and an outlet space communicating with the communication hole, and the oil introduced to the inlet space from the inlet hole is filtered by the filter element, discharged into the outlet space, and supplied to the crankshaft from the communication hole through the oil passage.

According to the structure, the filter flange increases the flexibility of the position with respect to where the oil filtering device is attached. Accordingly, it is possible to dispose the oil filtering device at a position the oil filtering device does not interfere with other constituent members disposed in the crankcase, thereby enabling miniaturization of the crankcase. Moreover, by removing the filter flange attached to the crankcase, it is possible to replace the filter element stored in the oil filtering device. Therefore, maintenance of the oil filtering device is improved.

Note that, with the oil filtering device according to the present invention, it is preferable that the crankcase includes a case main body which contains the crankshaft (e.g., left half case body 1*a* and right half case body 1*c* in an embodiment), and a cover member on which the oil passage and the connection hole are formed and which covers the crankshaft in an axis direction of the crankshaft (e.g., crank cover 1*b* in an embodiment), and the filter flange is retained when the lid of the filter flange is locked with the opening of the recess and the connection part of the filter flange is locked with the communication hole.

According to the structure, it is possible to remove the filter flange and the filter element from the crankcase easily by removing the cover member from the case main body of the crankcase. Thus, the maintenance of the oil filtering device can be further improved.

With the oil filtering device according to the present invention, it is preferable that the crankshaft has a rotary member in part covered with the cover member (e.g., ACG20 in an embodiment), and that the lid and the rotary member are disposed to partially overlap when viewed from a side in the axis direction of the crankshaft.

According to the structure, it is possible to dispose the oil filtering device, effectively utilizing a space in the crankcase without interfering with the rotary member. Therefore, the crankcase can be miniaturized.

DETAILED DESCRIPTION OF THE INVENTION

Figure 2:
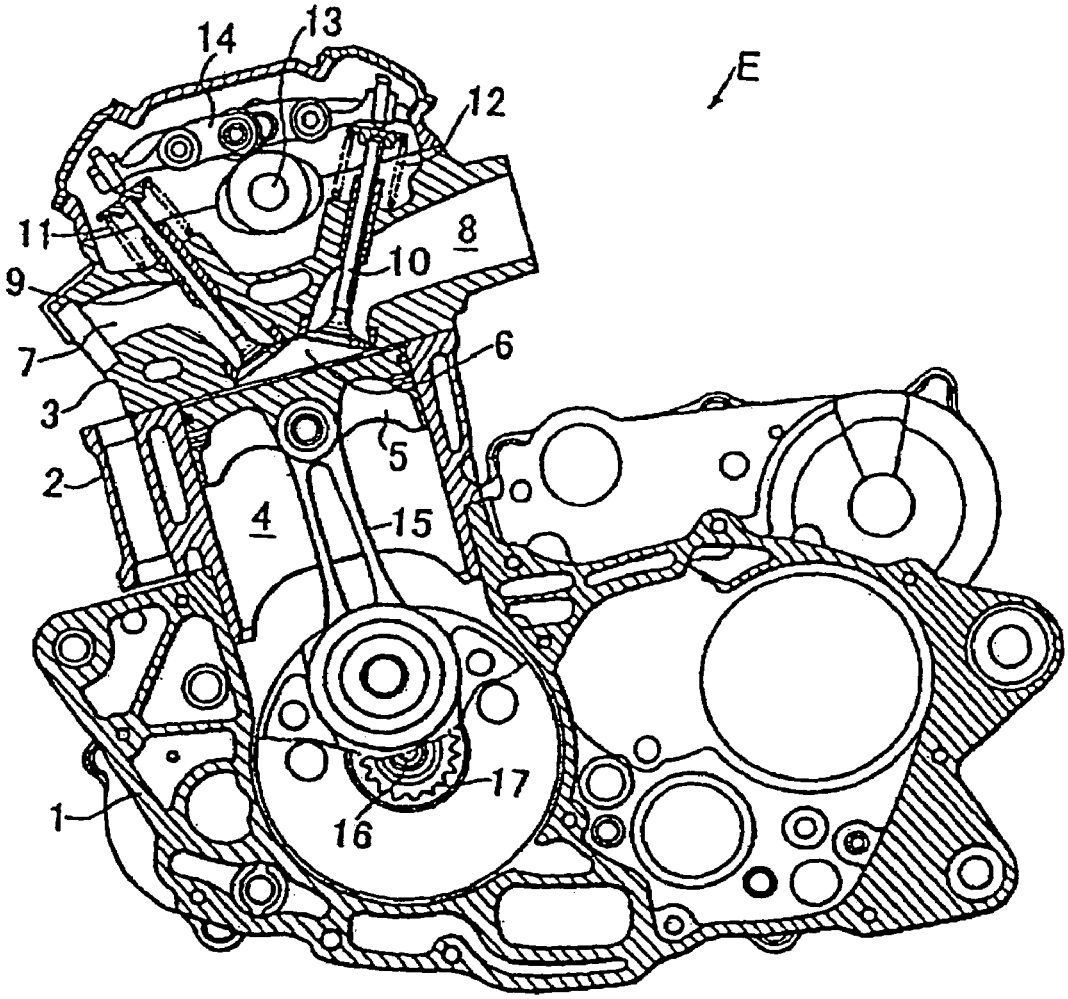
FIG. 2 PRIOR ART
FIG. 2 is a sectional view of an internal combustion engine to which the oil filtering device according to the present invention is attached.

Hereinafter, a preferred embodiment of the present invention is described with reference to the drawings. First, with reference to FIG. 2, a description is given of an internal combustion engine to which an oil filtering device according to the present invention is attached, and there is, a crankcase retaining a crankshaft in the internal combustion engine. A crankcase 1, a cylinder block 2, and a cylinder head 3 constitute an internal combustion engine E. A piston 5 is disposed in a cylinder chamber 4, which is formed in the cylinder block 2, so as to be vertically slidable. The piston 5 is connected to a crankshaft 16, which is rotatably retained in the crankcase 1, through a con rod 15. A combustion chamber 6 formed by the cylinder block 2 (the cylinder chamber 4), the cylinder head 3, and the piston 5 communicates with an intake port 7 and an exhaust port 8 through an intake entrance and an exhaust entrance, respectively. First ends of a mushroom intake valve 9 and a mushroom exhaust valve 10 are attached to valve shafts and supported by a retainer. Second ends are urged in a direction to close the intake entrance and the exhaust entrance constantly by valve springs 11 and 12 supported by the cylinder head 3.

Moreover, a camshaft 13 is rotatably disposed in the cylinder head 3 to cause the intake valve 9 and the exhaust valve 10 to open and close. A timing chain (not shown) is wound to a camshaft driven gear (not shown) of the camshaft 13 and a camshaft drive gear 17 disposed on the crankshaft 16. Accordingly, the camshaft 13 rotates in accordance with rotation of the crankshaft 16. Cam lobes formed on the camshaft 13 depresses the intake valve 9 and the exhaust valve 10 through a rocker arm 14 to open and close the intake entrance and exhaust entrance. In the internal combustion engine E thus structured, air-fuel mixture supplied to the combustion chamber 6 from the intake port 7 is compressed by the piston 5. After that, the air-fuel mixture is combusted and becomes energy for rotating the crankshaft 16 through the piston 5. Thereafter, the mixture is exhausted as exhaust gas to the outside from the exhaust port 8.

Figure 3:
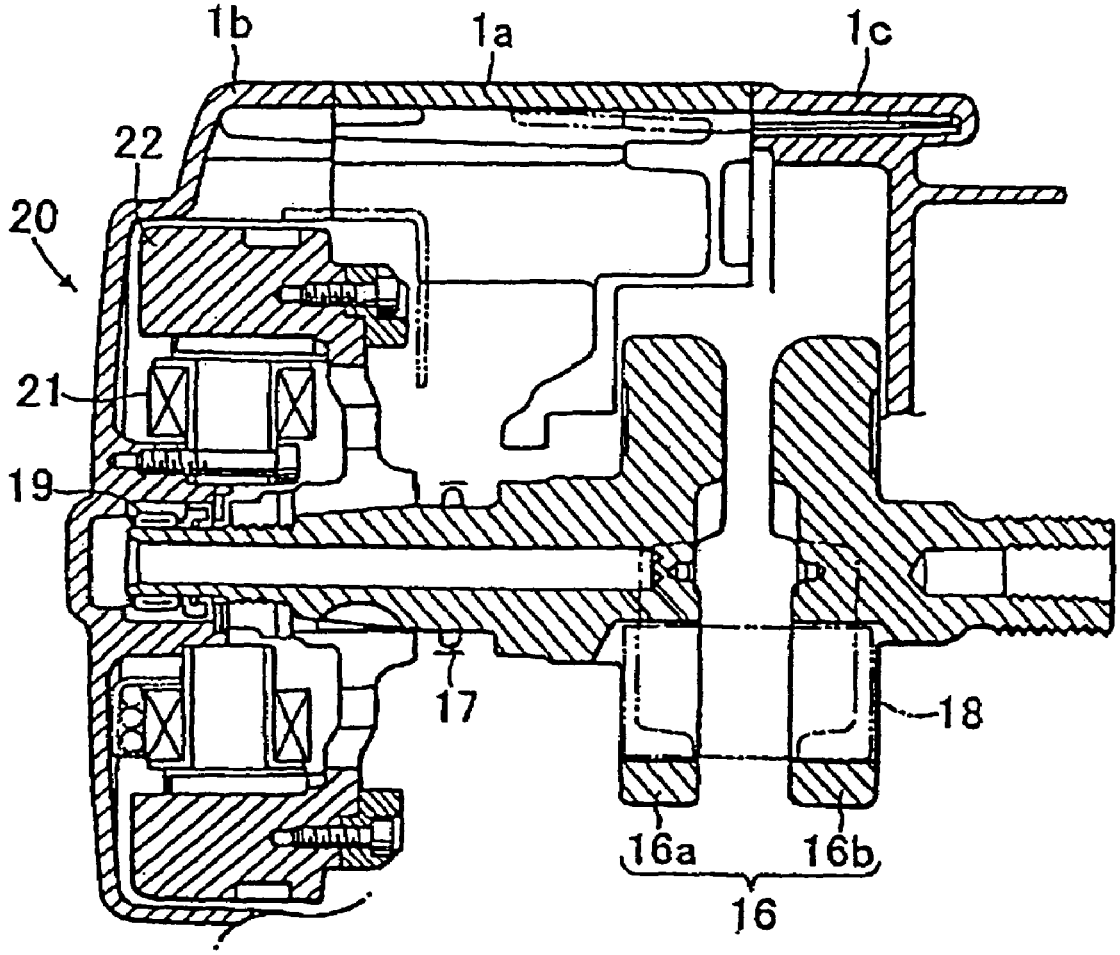
FIG. 3 PRIOR ART
FIG. 3 is a sectional view including an axis of a crankshaft of the crankcase.

As shown in FIG. 3, a left half crankshaft body 16*a* and a right half crankshaft body 16*b* constitute the crankshaft 16. The con rod 15 (not shown) is connected to the crankshaft 16 through a crankpin 18 which is disposed to connect the half crankshaft bodies 16*a* and 16*b*. Meanwhile, a left half case body 1*a*, a right half case body 1*c*, and a crank cover 1*b* constitute the crankcase 1 which stores the crankshaft 16. A first end (a journal of the left half crankshaft body 16*a*) of the crankshaft 16 is supported by the crank cover 1*b* through a bearing 19, and the second end (a journal of the right half crankshaft body 16*b*) is supported by the right half case body 1*c* through a bearing (not shown).

An ACG 20 is disposed at the tip of the journal of the left half crankshaft body 16*a*. The ACG 20 is constituted by a stator 21, which is disposed in the vicinity of the tip of the crankshaft 16 in the crank cover 1*b*, and a rotor 22, which is positioned to enclose the stator 21, disposed at the journal of the left half crankshaft body 16*a*, and can rotate about the stator 21.

Lubricating devices including the oil filtering device according to the present invention are disposed in the crankcase 1 thus constituted, in order to supply oil to the crankshaft 16 and the like. Hereinafter, these lubricating devices are described with reference to FIG. 1 and FIGS. 4 to 6. The oil used for lubricating the internal combustion engine E is accumulated in an oil pan (not shown) in the crankcase 1. An oil pump 23 is used to draw up the oil in the oil pan. The strainer and the like remove foreign matter. Thereafter, the oil is discharged from the oil pump 23 by a predetermined oil pressure. After an oil filtering device 24 removes metal powder, combustion products, and the like included in the oil, the oil discharged from the oil pump 23 is supplied to the crankshaft 16 and the like.

Figure 5:
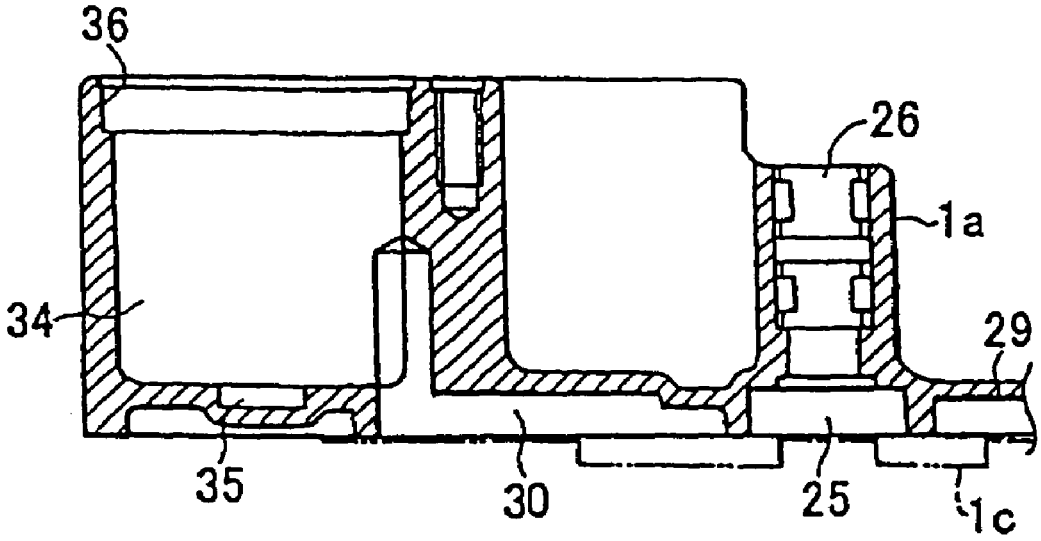
FIG. 5 is a V—V sectional view of FIG. 4.

The oil pump 23 suctions and discharges the oil by using a pump gear (not shown) driven by the rotation of the crankshaft 16. As shown in FIG. 5, a pump room 25 containing the pump gear of the oil pump 23 is constituted by combining spaces formed by the left half case body 1*a* and the right half case body 1*c*. A pump shaft 27 attached to the pump gear is rotatably supported by a bearing hole 26, which is formed on the left half case body 1*a* and communicates with the pump room 25. In addition, the pump room 25 communicates with an induction path 29 communicating with the oil pan and an inlet passage 30 communicating with the oil filtering device 24. Similar to the pump room 25, the left half case body 1*a* and the right half case body 1*c* constitute the induction path 29 and the inlet passage 30. A pump driven gear 28, which causes the pump shaft 27 to rotate, is disposed at the tip of the pump shaft 27. A pump drive gear 32, which meshes with the pump driven gear 28, is disposed at a pump driveshaft 31. The rotation of the crankshaft 16 is conveyed to the pump driveshaft 31 to drive, and the oil pump 23 is driven through the pump drive gear 32, the pump driven gear 28, and the pump shaft 27.

The oil filtering device 24 is stored by inserting the filter element 37 into a cylindrical filter storage 34 which has a base and is formed in the left half case body 1*a*. Meanwhile, the aforementioned inlet passage 30 communicates with the inside of the filter storage 34 from the base thereof. A filter flange 46 is attached to an opening 36 of the filter storage 34.

The filter element 37 has an accordion wound filter member 40 on the circumference of a cylindrical inner tube having numerous small holes. The filter element 37 is constituted by being sandwiched between disc-shaped upper end plate 41 and lower end plate 42 from both end surfaces in a cylindrical axis direction of the inner tube 39 and the filter member 40. An indent 41*a* penetrating in a thickness direction is formed substantially on the center of the upper end plate 41. A gasket 45 is disposed to enclose the indent 41*a*. Meanwhile, the filter element 37 has a spring receiver 43 formed concavely inside substantially on the center of the lower end plate 42. Furthermore, a relief valve 44 is disposed above the spring receiver 43.

Figure 6:
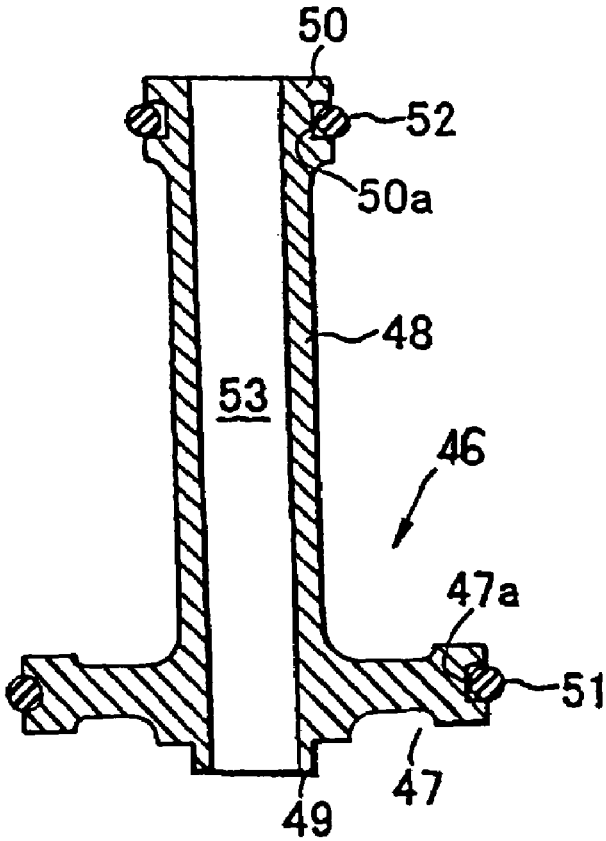
FIG. 6 is a sectional view of a filter flange.

As shown in FIG. 6, the filter flange 46 is constituted by a disc-shaped lid 47, an extension part 48 which extends cylindrically and substantially from the center of one surface of the lid 47, an element attachment part 49 which extends cylindrically from the other surface of the lid 47, and a connection part 50 which is formed on the tip of the extension part 48. Note that ring grooves 47*a* and 50*a* are formed on the circumferences of the lid 47 and the connection part 50. O-rings 51 and 52 are attached to the grooves 47*a* and 50*a* to protrude outward. In addition, a communication passage 53, which penetrates in the cylindrical axis direction of the extension part 48, is formed inside the connection part 50, the extension part 48, the lid 47, and the element attachment part 49.

In the oil filtering device 24 thus constituted, a spring 38 is disposed on a spring receiver 35 in the filter storage 34, and the filter element 37 is inserted from the lower end plate 42 from the top thereof. At this time, the spring 38 is disposed in the spring receiver 43 of the filter element 37 and sandwiched between the spring receivers 35 and 43. Then, the element attachment part 49 of the filter flange 46 is inserted into the opening 41*a* of the upper end plate 41 of the filter element 37. The opening 36 of the filter storage 34 is fitted in the lid 47 of the filter flange 46, and the element attachment part 49 is attached.

As described above, the space enclosed by the filter storage 34 and the lid 47 of the filter flange 46 is hermetically sealed by the O-ring 51 attached to the lid 47 since the sections of the opening 36 of the filter storage 34 and lid 47 of the filter flange 47 have substantially the same shape. Moreover, the filter element 37 is lifted upward by the spring 38, urged toward the lid 47, and fitted since the sections of the indent 41*a* of the upper end plate 41 and the element attachment part 49 of the filter flange 46 have substantially the same shape. The filter element 37 is sealed by the gasket 45. Accordingly, an internal space of the filter storage 34 is separated into an outer circumferential space 54 which is the outer side of the filter element 37 and communicates with the inlet passage 30 and an inner circumferential space 55 which is an internal space of the filter element 37 and communicates with the communication passage 53 of the filter flange 46, by the filter element 37.

Meanwhile, a bearing chamber 56, in which the bearing 19 pivotally supporting the aforementioned crankshaft 16 is disposed, is formed in the crank cover 1*b*. An oil passage 57 is formed, communicating with the bearing chamber 56. A cylindrical flange connection part 58, which protrudes toward the left half case body 1*a*, is formed inside the crank cover 1*b*. The flange connection part 58 communicates with the oil passage 57. When the crank cover 1*b* is attached to the left half case body 1*a*, the connection part 50 of the aforementioned filter flange 46 is fitted in the flange connection part 58 and sealed by the O-ring 52. Accordingly, the oil passage 57 and the communication passage 53 communicate with each other. The filter flange 46 is locked with and retained by the left half case body 1*a* and the crank cover 1*b*.

Thus, the oil pump 23 draws up the oil accumulated in the oil pan of the crankcase 1 to the pump room 25 through the induction path 29. The oil is discharged to the inlet passage 30 by the predetermined pressure and introduced to the outer circumferential space 54 of the oil filtering device 24. Thereafter, the oil passes through the filter element 37, and metal powder and combustion product are removed. The clean oil flows into the inner circumferential space 55. Moreover, the oil flows out to the inner circumferential space 55, passes through the communication passage 53 of the filter flange 46 and the oil passage 57 formed in the crank cover 1*b* and supplied to the bearing chamber 56 (the bearing 19 located therein).

Figure 1:
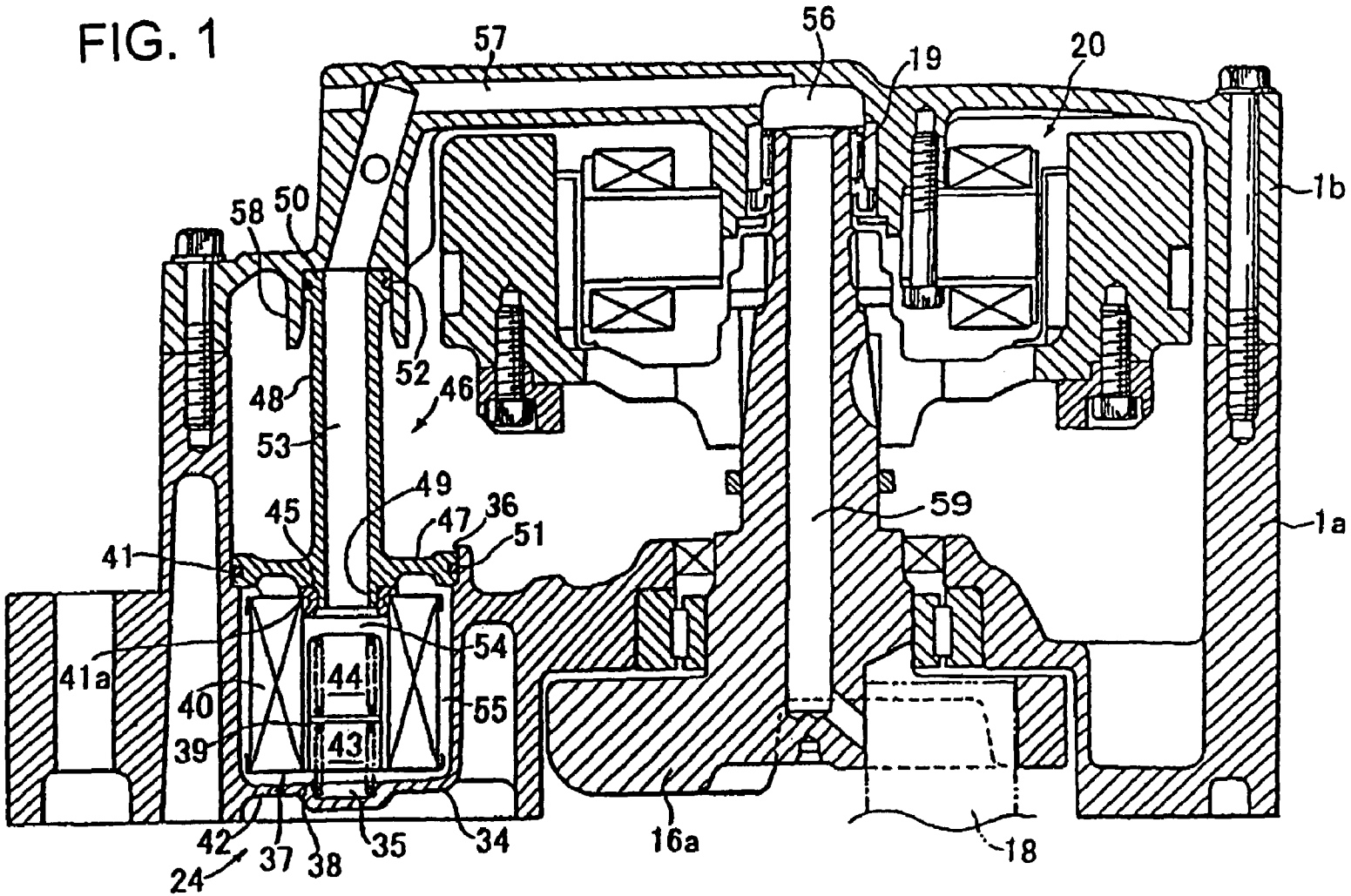
FIG. 1 is an I—I sectional view of FIG. 4 of a crankcase including an oil filtering device according to the present invention.

Note that, as shown in FIG. 1, an oil passage 59, which penetrates in an axis direction and opens toward the bearing chamber 56 and the crankpin 18, is formed in the left half crankshaft body 16*a*. The oil is also supplied to the crankpin 18 through the oil passage 59.

Figure 4:
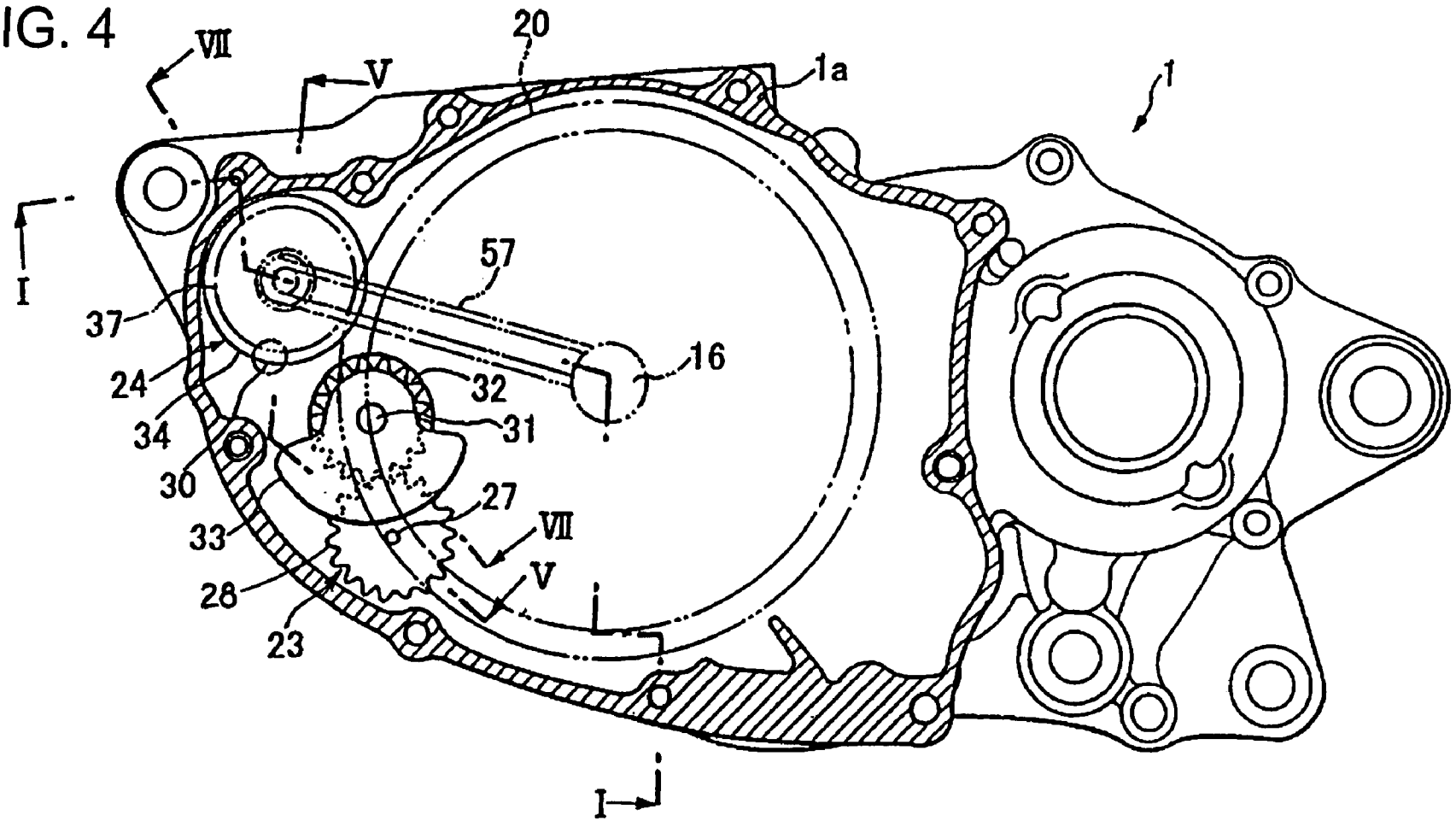
FIG. 4 is a side view of the crankcase (left half case body) according to the present invention when a crank cover is removed.

As described above, by connecting the filter storage 34 and the oil passage 57 formed in the crank cover 1*b* with the filter flange 46, it is unnecessary to dispose the oil filtering device 24 in the vicinity of the tip (the bearing chamber 56 formed in the crank cover 1*b*) of the crankshaft 16. Accordingly, as shown in FIG. 4, it is possible to dispose the filter element 37 and the like at a position which does not interfere with the rotary member (accessory) constituted by the ACG 20 and the like attached to the tip of the crankshaft 16, and the flexibility of the disposal is improved. Moreover, by positioning the filter element 37 and the like further inside of the crankcase 1 than the ACG 20 and disposing the ACG 20 and the oil filtering device 24 (the lid 47 of the filter flange 46) to partially overlap when viewed from the top in the axis direction of the crankshaft 16, the spaces in the crankcase 1 can be effectively utilized, thereby enabling miniaturization of the crankcase 1.

In addition, by removing the crank cover 1*b* from the left half case body 1*a* of the crankcase 1, it is possible to remove the filter flange 46 and the filter element 37 easily from the opening of the left half case body 1*a* covered with the crank cover 1*b*. Thus, the maintenance of the oil filtering device 24 can be improved.

Figure 7:
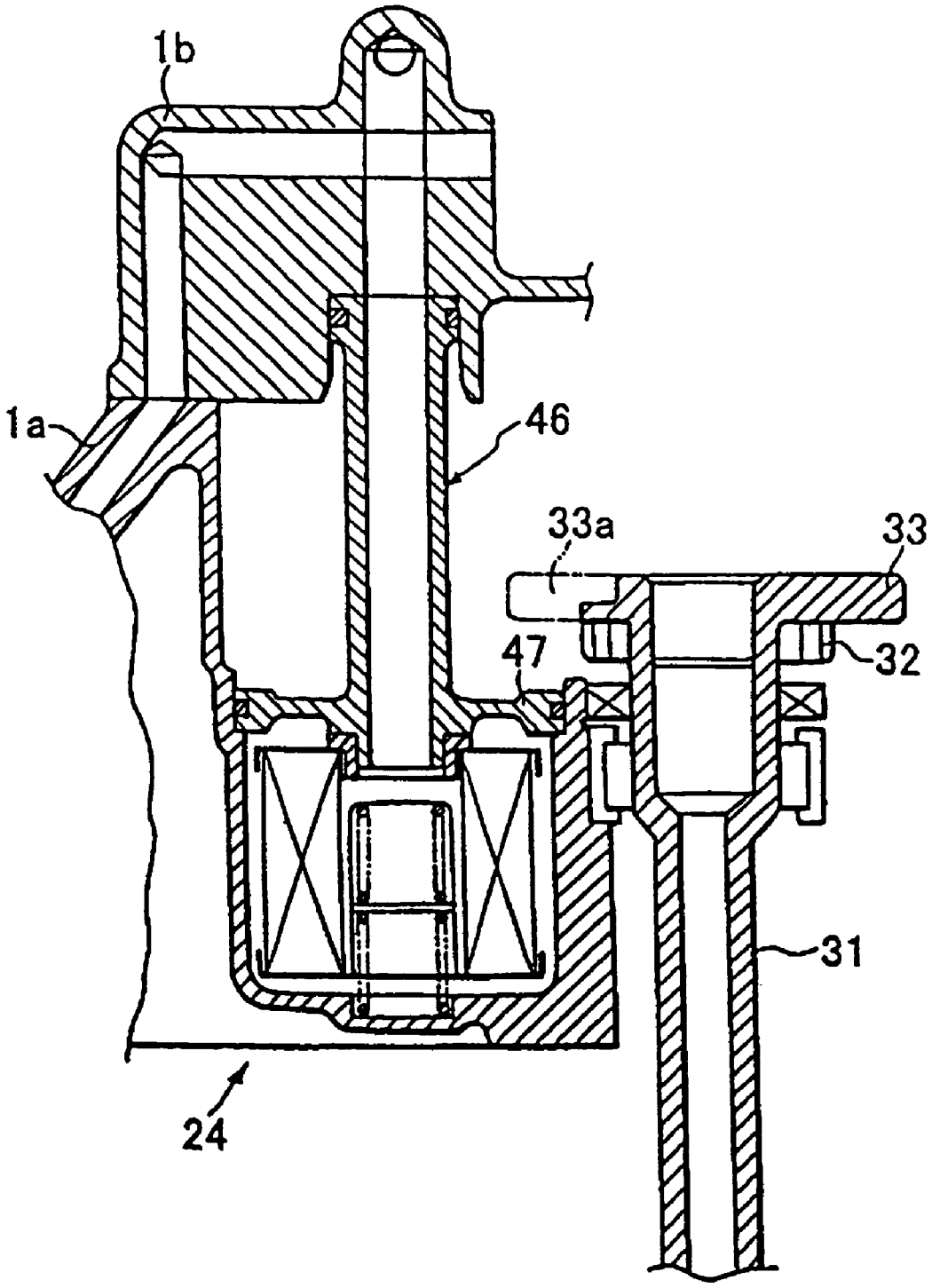
FIG. 7 is a VII—VII sectional view of FIG. 4.

Note that, as shown in FIG. 7, the pump drive shaft 31 is disposed in the vicinity of the oil filtering device 24 to further miniaturize the crankcase 1 in the present embodiment. In this case, a balancer 33 which is disposed on the tip of the pump drive shaft 31 for suppressing vibration and the like and the lid 47 of the filter flange 46 are positioned to interfere with each other when the filter flange is attached and removed. However, as shown in FIG. 4, the balancer 33 has a shape in which part of a disc is cut off. Thus, by rotating and moving the pump drive shaft 31 to position a cutout part 33*a* of the balancer 33 above the lid 47, it is possible to position the balancer 33 and the lid 47 not to interfere with each other. Thus, the attachment and detachment of the filter flange 46 and the replacement of the filter element 37 are facilitated.

Having thus explained, according to the oil filtering device of the present invention, the oil filtering device can be disposed in the crankcase by the filter flange, and the flexibility of the disposal is improved. The oil filtering device can be disposed at a position which does not interfere with other constituent members disposed in the crankcase. Accordingly, it is possible to miniaturize the crankcase. Moreover, by removing the filter flange attached to the crankcase, it is possible to replace the filter element stored in the oil filtering device. The maintenance of the oil filtering device is improved.

Moreover, the crankcase is constituted by the case main body and the cover member which covers the crankshaft contained in the case main body from the axis direction. The crankcase is structured so that one end of the filter flange is locked with the case main body, and the other end is locked with the cover member to retain the filter flange. Accordingly, by removing the cover member from the case main body of the crankcase, it is possible to remove the filter flange and the filter element from the crankcase easily. Thus, the maintenance of the oil filtering device can be further improved.

Furthermore, by disposing the rotary member of the crankshaft and the lid of the filter flange to partially overlap when viewed from a side from the axis direction of the crankshaft, it is possible to dispose the rotary member and the oil filtering device without interfering with each other, utilizing the space in the crankcase. Therefore, the crankcase can be further miniaturized.

What is claimed is:

1. An oil filtering device, in which a crankcase of an internal combustion engine rotatably retains a crankshaft inside, and an oil passage supplying oil to the crankshaft and a connection passage communicating with the oil passage are formed in the crankcase, comprising:

a filter element disposed in a recess formed inside the crankcase; and a filter flange having a flat lid which has substantially a same shape as an opening of the recess and is fitted in the recess, a cylindrical extension part which extends outward substantially from a center of the lid and in which a communication passage is formed inside, and a connection part which is formed on a tip of the extension part and is fitted in the communication hole passage, wherein, the filter element is disposed to separate a space enclosed by the recess and the lid into an inlet space communicating with an inlet passage formed thereon and an outlet space communicating with the communication passage, and the oil introduced to the inlet space from the inlet passage is filtered by the filter element, discharged into the outlet space, and supplied to the crankshaft from the communication passage through the oil passage.

2. The oil filtering device according to claim 1, wherein, the crankcase comprises a case main body which contains the crankshaft, and a cover member on which the oil passage and the connection passage are formed and which covers the crankshaft in an axis direction of the crankshaft, and the filter flange is retained in that the lid of the filter flange is locked with the recess and the connection part of the filter flange is locked with the communication passage.

3. The oil filtering device according to claim 1, the crankshaft has a rotary member at a part covered with the cover member, and the lid and the rotary member are disposed to partially overlap when viewed from a side in the axis direction of the crankshaft.

4. The oil filtering device according to claim 1, including the internal combustion engine.

* * * * *